US007416029B2

(12) United States Patent
Telfer et al.

(10) Patent No.: US 7,416,029 B2
(45) Date of Patent: Aug. 26, 2008

(54) DOWNHOLE TOOL

(75) Inventors: George Telfer, Aberdeen (GB); Edward Docherty Scott, Cardenden (GB); Rae Andrew Youngor, Aberdeenshire (GB); James Edward Atkins, Aberdeen (GB)

(73) Assignee: Specialised Petroleum Services Group Limited, Westhill Aberdeen (GB)

( * ) Notice: Subject to any disclaimer, the term of this patent is extended or adjusted under 35 U.S.C. 154(b) by 0 days.

(21) Appl. No.: 10/551,678

(22) PCT Filed: Mar. 31, 2004

(86) PCT No.: PCT/GB2004/001449

§ 371 (c)(1),
(2), (4) Date: Jul. 3, 2006

(87) PCT Pub. No.: WO2004/088091

PCT Pub. Date: Oct. 14, 2004

(65) Prior Publication Data

US 2006/0243455 A1 Nov. 2, 2006

(30) Foreign Application Priority Data

| | | |
|---|---|---|
| Apr. 1, 2003 | (GB) | 0307521.5 |
| Apr. 3, 2003 | (GB) | 0307724.5 |
| Apr. 4, 2003 | (GB) | 0307825.0 |
| Apr. 8, 2003 | (GB) | 0308080.1 |

(51) Int. Cl.
*E21B 34/00* (2006.01)

(52) U.S. Cl. ..... 166/386; 166/318; 166/322.5

(58) Field of Classification Search ..... None

See application file for complete search history.

(56) References Cited

U.S. PATENT DOCUMENTS

| | | | | |
|---|---|---|---|---|
| 4,889,199 | A | 12/1989 | Lee | |
| 4,991,654 | A | 2/1991 | Brandell et al. | |
| 5,499,687 | A | 3/1996 | Lee | |
| 6,065,541 | A | 5/2000 | Allen | |
| 6,098,713 | A * | 8/2000 | Ross | 166/297 |
| 6,152,228 | A | 11/2000 | Carmichael | |
| 6,220,357 | B1 | 4/2001 | Carmichael et al. | |
| 6,227,291 | B1 | 5/2001 | Carmichael et al. | |
| 6,253,861 | B1 | 7/2001 | Carmichael et al. | |
| 2002/0074128 | A1 | 6/2002 | Allamon et al. | |

FOREIGN PATENT DOCUMENTS

| | | |
|---|---|---|
| EP | 0 158465 | 10/1985 |
| EP | 0 223552 | 5/1987 |
| GB | 2102045 | 1/1983 |
| GB | 2247481 | 3/1992 |

(Continued)

*Primary Examiner*—Frank S Tsay
(74) *Attorney, Agent, or Firm*—Osha Liang, LLP

(57) ABSTRACT

A downhole tool which can perform a task in a well bore, such as circulating fluid radially from the tool. The function is selectively performed by virtue of a sleeve moving within a central bore of the tool. Movement of the sleeve is effected by dropping a ball through a ball seat on the sleeve. Movement of the sleeve is controlled by an index sleeve such that the tool can be cycled back to the first operating position by dropping identical balls through the sleeve. Embodiments are described wherein the balls are deformable, the seat is deformable and the seat provides a helical channel through which the ball passes.

44 Claims, 7 Drawing Sheets

FOREIGN PATENT DOCUMENTS

| | | | |
|---|---|---|---|
| GB | 2248465 | | 8/1992 |
| WO | WO 01/90529 | | 11/2001 |
| WO | WO 01/90529 | A1 | 11/2001 |
| WO | WO 02/061236 | | 8/2002 |
| WO | WO 02/061236 | A1 | 8/2002 |
| WO | WO 02/068793 | | 9/2002 |
| WO | WO 02/068793 | A1 | 9/2002 |

* cited by examiner

DOWNHOLE TOOL

CROSS-REFERENCE TO RELATED APPLICATIONS

This application claims priority form PCT/GB04/001449, having an international filing date of 31 Mar. 2004, and a priority date of 1 Apr. 2003 (from GB0307521.5), 3 Apr. 2003 (from GB0307724.1), 4 Apr. 2003 (from GB0307825.0), and 8 Apr. 2003 (from GB0308080.1).

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The present invention relates to the selective operation of downhole tools as used in the oil and gas industry and in particular, though not exclusively, to a re-settable circulation tool operated by a drop ball mechanism.

While many downhole tools operate continuously through a well bore e.g. scrapers and brushes as disclosed in U.S. Pat. No. 6,227,291, it is more desirable to provide a tool which performs a function only when it has reached a preferred location within a well bore. An example of such a tool would be a circulation tool as disclosed in WO 02/061236. The tool provides a cleaning action on the walls of the casing or lining of the well bore. The cleaning action may be required after the casing has been brushed or scraped and thus the tool is designed to be selectively actuated in the well bore. Such tools provide the advantage of allowing an operator to mount a number of tools on a single work string and operate them individually on a single trip in to the well bore. This saves significant time in making the well operational.

Tools which are selectively actuable in a well bore commonly operate by having an element which can be moved relative to the tool when in the well bore. In the circulation tool of WO 02/061236, the element is a sleeve located in the cylindrical body of the tool. When run in the well, the sleeve is held in a first position by one or more shear screws. To actuate the tool, a drop ball is released from the surface of the well through the work string. On reaching the sleeve, the ball blocks the flow of fluid through the tool and consequently pressure builds up until the shear screws shear and the sleeve is forced downwards. The movement of the sleeve is then stopped when a lower ledge of the sleeve contacts a shoulder on the internal surface of the tool body.

Such tools have a number of disadvantages. The tools are generally limited to one actuable movement. If two sleeves are incorporated to overcome this, the shear screws of the second sleeve can operate prematurely under the shock created to shear the shear screws of the first sleeve. Additionally, the reduced bore diameter of the lower part also effects the flow rate achievable through the tool.

One tool which has been developed to operate repeatedly is that disclosed in U.S. Pat. No. 4,889,199. This tool comprises a tubular body having a radial port into which is located a sleeve having a matching radial port. The sleeve is slidably mounted and its action controlled from a deformable drop ball biasing the sleeve against a spring. Initially the spring biases the sleeve to a closed position in which the ports are misaligned. The drop ball causes the sleeve to move to a position where the ports align due to a build up of pressure behind the ball, and fluid is discharged radially through the ports. A small steel ball is then dropped into the tool which seals the radial ports and the consequential pressure build up extrudes the deformable ball through the ball seat. The steel ball will drop with the deformable ball and both are retained in a ball catcher at the base of the tool. When the balls drop together the spring biases the sleeve back to the closed position and the tool can be operated repeatedly.

A disadvantage of this tool is that it requires both a deformable ball and a smaller metal ball to operate. Care must then be taken to ensure the balls are dropped in the correct order. The smaller metal ball must lodge in the second, radial, outlet in order to stop flow and thus the tool is restricted to having a single radial port. This limits the amount of cleaning which can be performed.

It is an object of the present invention to provide a downhole tool which obviates or mitigates at least some of the disadvantages of the prior art.

It is a further object of at least one embodiment of the present invention to provide a circulation tool which is resettable and operated by similar drop balls.

It is a further object of at least one embodiment of the present invention to provide an actuation mechanism to move a sleeve within a downhole tool.

SUMMARY OF THE INVENTION

According to a first aspect of the present invention there is provided a downhole tool for selectively performing a task in a well bore, the tool comprising a substantially cylindrical body having a central bore running axially therethrough, a sleeve located within the bore, the sleeve including a ball seat, a plurality of balls, each ball having substantially similar dimensions and each ball arresting a majority of fluid flow through the bore when located in the ball seat, mechanical biasing means located between the sleeve and the body to bias the sleeve in a first direction, and functional means on the body to perform a task in the well bore, the functional means being operable on relative movement of the sleeve, wherein the functional means has at least a first and a second operating position, each change in position being effected by passing a said ball through the sleeve in a reverse direction, and wherein the said changes form a cyclic pattern such that the functional means can be cycled back to the first operating position.

The tool can therefore be operated a number of times while located in a well bore. Further all operations are controlled by dropping identical balls through the tool and thus there is no co-ordination required in dropping the balls.

It will be appreciated that while the term ball has been used, this represents any shaped projectile which can be dropped into the fluid flow, travel to and seat in the ball seat, and further travel through the ball seat. Such projectiles may be plugs, bombs darts or the like.

Preferably the ball seat releasably retains each ball. Preferably the ball seat is a ledge or shoulder located on an inner surface of the sleeve means. The ball therefore rests on the shoulder until sufficient pressure builds up to force the ball past the shoulder.

In a first embodiment, the balls are deformable. In this way each ball can be released by passing through the ball seat when sufficient pressure is applied to it.

When a ball is dropped in the body, the ball will locate in the ball seat. The ball will block the fluid path through the tool and consequently pressure will build up on the ball by fluid prevented from travelling through the body. This pressure will be sufficient to move the ball and sleeve together against the mechanical bias and force the sleeve in the reverse direction. When the limit of the bias is reached, increased pressure will cause the ball to deform and pass through the ball seat. On release of the ball, pressure drops and the sleeve is biased in the first direction. The movement of the sleeve actuates the tool and moves the functional means to an operating position.

In a second embodiment, the ball seat may be a deformable ball seat. Preferably the deformable ball seat includes a part conical surface having an aperture therethrough. Advantageously the aperture has a diameter less than a diameter of the ball. Preferably the deformable ball seat is made of a flexible material, so that at a predetermined pressure it flexes to release the ball. Advantageously the deformable ball seat is made of a metal so that the seat is not prone to wear during use.

The deformable ball seat may comprise a spring such as a disc spring. Preferably the deformable ball seat has sufficient elasticity such that it returns to its original dimensions once a ball has passed therethrough.

Optionally the deformable ball seat may be of a layered structure. Preferably the layered structure comprises a plurality of disc springs.

Throughout this specification the term deformable refers to the ability of an element to change shape within its own volume as it deforms. This is in contrast to expandable wherein the element must get bigger i.e. extend beyond its outer diameter.

Preferably the balls of the second embodiment are spherical. More preferably the balls are of a non-pliable material and thus cannot deform. Advantageously the balls are made of steel.

In the second embodiment, when a ball is dropped in the body, the ball will locate in the deformable ball seat. The ball will block the fluid path through the tool and consequently pressure will build up on the ball by fluid being impeded in travelling through the body. This pressure will be sufficient to move the ball and sleeve together against the mechanical bias and force the sleeve in the reverse direction. When the limit of the bias is reached, increased pressure will cause the seat to expand against the pressure of the ball. The ball will pass through the expanded ball seat. On release of the ball, pressure drops and the sleeve is biased in the first direction. The movement of the sleeve actuates the tool and moves the functional means to an operating position.

In a third embodiment the ball seat may comprise a helical channel on an inner surface of the sleeve.

Preferably the helical channel has curved walls. This will prevent damage to a ball passing through the channel. Preferably also the ball is sized to provide a restricted fluid bypass around the ball when in the channel. This ensures a positive pressure is maintained behind the ball and prevents chattering of the ball in the channel.

The helical channel may be considered as a screw thread. Thus the channel has a left hand thread so that a ball travels in the opposite direction to the rotation of the tool on a work string. Preferably a pitch of the thread is greater than or equal to a diameter of each ball.

Preferably the balls are spherical. More preferably the balls are of a non-pliable material and thus cannot deform. Advantageously the balls are made of steel.

Preferably also the sleeve includes a conical surface at an entrance to the channel. This funnels the ball into the channel and ensures it travels into the helical path.

For this embodiment, when a ball is dropped in the body, fluid will drive the ball into the channel and into the helical path. As the ball is sized for the channel it will block the majority of the fluid path through the tool and consequently pressure will build up behind the ball. This pressure will be sufficient to move the ball and sleeve together against the spring and force the sleeve in the reverse direction. On release of the ball from the channel the sleeve is biased in the first direction. The movement of the sleeve actuates the tool and moves the functional means to an operating position.

Preferably the mechanical biasing means is a strong spring. The spring may be helical, conical or the like. A strong spring will prevent the sleeve moving in the reverse direction by fluid flow in the central bore.

Preferably also the mechanical biasing means is located in a chamber created between the sleeve and the body. Advantageously the chamber includes an exhaust port such that fluid can enter and be dispelled from the chamber by relative movement of the sleeve and the body. This provides a damping effect which prevents shock movements in the tool.

Preferably a choke ring is located around the sleeve. Preferably the ring has an extended portion in the longitudinal plane to provide an extended surface area to match the outer surface of the sleeve for fluid to flow therebetween. The shape of the ring, assists in providing a damping action as the sleeve moves in the reverse direction. Fluid which has to pass the sleeve as it moves downwards is forced to take a route having a restricted flow path in the first direction. This damping helps prevent the mechanical bias e.g. a spring or other parts, from 'bouncing' into a location which could result in the functional means being moved to an unwanted operating position.

Preferably the tool further comprises engagement means to control relative movement between the sleeve and the body. Preferably also the mechanical bias biases the sleeve against the engagement means.

Preferably said engagement means comprises at least one index pin located in a profiled groove. Preferably the at least one index pin is located on the body and the profiled groove is located on an outer surface of the sleeve. In this way, an index sleeve is produced with the groove determining the relative position of the sleeve to the body. Advantageously the groove extends circumferentially around the sleeve, this enables the tool to be continuously cycled through a number of operating positions.

Preferably the tool further includes a ball non-return element. Preferably the element is a split ring located in the bore below the sleeve. Advantageously the ring is located at the base of a ramp on an inner surface of the body. Preferably the ramp is arranged such that if a ball pushes against the ring in the first direction, the ring will travel up the ramp and thereby reduce in diameter as edges of the split are forced together. This reduction in diameter will prevent a ball from travelling in a first direction back up through the tool.

Advantageously the tool includes a ball arrester. Preferably the arrester is located below the ball seat. The inner surface of the sleeve may be shaped to provide the ball arrester. Preferably the ball arrester comprises a plurality of surfaces transversely arranged to the central bore. Preferably the surfaces provide a convoluted path which a ball must take through the sleeve. Preferably the path is sized such that fluid may pass around the ball during its passage. In this way, the momentum of the ball as it passes through the seat is dissipated before the ball reaches any further ball seats in the tool or in the work string to which it is attached. This prevents the ball 'exploding' through restrictions in the bore and allows restrictions, such as further ball seats, to be mounted relatively closely to the ball seat.

Preferably the tool further comprises a second ball seat. The second ball seat is located below the sleeve and allows the central bore to be blocked in any operating position, if desired.

The second ball seat may comprise a collet including a plurality of fingers directed in the first direction. Preferably the collet is closed and the fingers are brought together by the action of the sleeve locating between the fingers and the body. In this way, when the sleeve is moved in the reverse direction the passage through the central bore is restricted as the collet closes. A ball is then arrested on the collet. When the sleeve moves in the first direction by a predetermined distance the collet opens and the ball is released to travel through the tool.

Alternatively the second ball seat may comprise a trapped 'C' ring, or split ring. Again movement of the sleeve between the ring and the body will cause the ring to be compressed wherein its diameter reduces. A ball will therefore be prevented from passing through the bore and be impeded at the ring. Movement of the sleeve in the first direction by a predetermined direction will free the ring and, by expansion, the ball can pass through the now increased aperture.

Advantageously the second ball seat is a shuttle arrangement. The shuttle arrangement comprises a plurality of part cylindrical sleeves. Preferably the sleeves combine to form a complete sleeve which is located in the body. Preferably at least a first part cylindrical sleeve is connected to the sleeve, such that it moves with the sleeve. Preferably at least a second part cylindrical sleeve is attached to the body and is prevented from longitudinal movement in the bore. Preferably the part cylindrical sleeves overlap in the bore at all times, such that movement of the sleeve brings them into sliding engagement. More preferably, when the sleeves are brought together, the internal bore created has a diameter smaller than the diameter of the balls, but that one or more balls can pass between a part cylindrical sleeve and an inner surface of the body. Preferably a free end of each part cylindrical sleeve includes a funnel portion. More preferably the funnel reduces the diameter of the part cylindrical sleeve from that of substantially the body to that of the inner bore. The funnel may be stepped. In this way, only when then the funnels of each part cylindrical sleeve are aligned can balls pass through the second ball seat.

Preferably the tool is a circulation tool. The functional means may comprise at least one first port arranged substantially transversely to the central bore through the body, and at least one second port arranged transversely to the central bore through the sleeve, such that alignment of the ports causes fluid to be discharged from the central bore and wherein alignment of the ports is controlled by relative movement of the sleeve.

More preferably there are a plurality of said first and said second ports. Advantageously there are three or more said first and said second ports. Preferably also said first and said second ports are spaced equidistantly around the body and sleeve respectively.

Preferably also the tool includes ball collecting means. The ball collecting means may be an element located in the casing means to prevent passage of the ball through the tool, but allowing passage of fluid through the tool.

According to a second aspect of the present invention there is provided a method of circulating fluid in a borehole, the method comprising the steps:

(a) inserting in a work string a tool comprising a tubular body including a plurality of first radial outlet ports in which is located a sleeve including a plurality of second radial outlets;

(b) running the work string and tool into a borehole, with the sleeve in a first position relative to the body wherein the first and second radial outlets are arranged in a first operating position;

(c) dropping a ball into the work string such that the ball lands on the sleeve and forces the sleeve into a second position relative to the casing wherein the first and second radial outlets are arranged in an intermediate operating position and fluid flow is restricted by the ball;

(d) increasing pressure behind the ball to cause the ball to pass through the sleeve, the releasing pressure allowing the sleeve to move to a third position relative to the body wherein the first and second radial outlets are arranged in a second operating position; and wherein the ports are aligned in either of the operating positions and misaligned in the other operating position.

In this way, the tool can be run into the borehole with the ports in an open or closed configuration. The intermediate position is a position where the tool is primed between the first and second operating positions.

Preferably the method further includes the steps of:

(e) dropping a second ball, substantially similar to the first ball, into the work string such that the second ball lands on the sleeve and forces the sleeve into the second position relative to the body wherein the first and second radial outlets are arranged in the intermediate operating position and fluid flow is restricted by the second ball; and (f) increasing pressure behind the second ball to cause the second ball to pass through the sleeve, the releasing pressure allowing the sleeve to move to the first position relative to the body wherein the first and second radial outlets are arranged in the first operating position.

With the sleeve and body back in the first position, the steps (c) to (f) can be repeated. In this way the tool can operate in a cyclic manner.

Preferably the method includes the step of moving the sleeve against a mechanical bias.

Preferably the method includes the step of controlling movement of the sleeve relative to the body by use of an index sleeve.

Preferably the method includes the step of decelerating the ball as it passes from the sleeve to dissipate the pressure.

Preferably the method includes the step of stopping the ball in a second ball seat after it has passed through the sleeve. Preferably this step further includes the step of preventing fluid flow through the work string while directing it through the radial ports.

Preferably also the method includes the step of catching the dropped balls in the work string.

According to a third aspect there is provided a ball arrester for dissipating momentum of a ball after it has passed through a ball seat, the arrester comprising a substantially cylindrical body in which is located a non-linear pathway through which the ball is guided.

Preferably the pathway comprises a plurality of surfaces transversely arranged to a central bore. Preferably each transverse path has a curved ramp extending therefrom to the next transverse surface. Preferably also each transverse surface extends across a portion of the bore so that the ball can pass between the surfaces. Advantageously adjacent surfaces are off-set so that the ball is forced to run along each surface before travelling to the next surface. Preferably the surfaces provide a convoluted path which a ball must take through the body. Preferably the path is sized such that fluid may pass around the ball during its passage. In this way, the kinetic energy of the ball as it passes through the seat is dissipated before the ball reaches any further ball seats in a tool or in the work string to which it is attached. This prevents a ball 'exploding' through restrictions in the bore and allows restrictions, such as further deformable ball seats, to be mounted relatively closely to the ball seat.

According to a fourth aspect of the present invention there is provided a ball seat for a downhole tool, the ball seat comprising a plurality of part cylindrical sleeves which can shuttle with respect to each other, longitudinally in the tool, wherein a ball can only pass through the seat when the sleeves are located at their longitudinal extent.

Preferably the sleeves combine to form a complete sleeve which is located in a cylindrical bore of the tool. Preferably at least a first part cylindrical sleeve is moveable within the tool. Preferably at least a second part cylindrical sleeve is attached to the tool and is prevented from longitudinal movement in the bore. Preferably the part cylindrical sleeves overlap in the bore at all times, such that movement of the first brings them into sliding engagement by a shuttle motion. More preferably, when the sleeves are brought together, the internal bore created has a diameter smaller than the diameter of a ball directed at the seat, but that a ball can pass between a part cylindrical sleeve and an inner surface of the tool. Preferably a free end of each part cylindrical sleeve includes a funnel portion. More preferably the funnel reduces the diameter of the part cylindrical sleeve from that of substantially the body to that of the inner bore. The funnel may be stepped. In this way, only when the funnels of each part cylindrical sleeve are aligned can balls pass through the ball seat.

According to a fifth aspect of the present invention there is provided an actuation mechanism for a downhole tool, the mechanism comprising a substantially cylindrical body having a central bore running axially therethrough, a sleeve located within the bore, the sleeve including an deformable ball seat, mechanical biasing means located between the sleeve and the body to bias the sleeve in a first direction and a ball, wherein the deformable ball seat releasably retains the ball to prevent fluid flow through the sleeve and cause the sleeve to move in the reverse direction relative to the body and wherein on release of the ball the seat returns to its original dimensions.

Preferably the mechanical bias is a strong spring. The spring may be helical, conical or the like. A strong spring will prevent the sleeve moving in the reverse direction by fluid flow in the central bore.

Preferably the deformable ball seat includes a part conical surface having an aperture therethrough. Advantageously the aperture has a diameter less than a diameter of the ball. Preferably the ball seat is made of a flexible or elastic material, so that at a predetermined pressure it flexes to release the ball. Advantageously the ball seat is made of a metal so that the seat is not prone to wear during use. The ball seat my comprise a spring such as a disc spring.

Optionally the ball seat may be of a layered structure. Preferably the layered structure comprises a plurality of disc springs.

Preferably the ball is spherical. More preferably the ball is of a non-pliable material and thus cannot deform. Advantageously the ball is made of steel.

According to a sixth aspect of the present invention there is provided an actuation mechanism for a downhole tool, the mechanism comprising a substantially cylindrical body having a central bore running axially therethrough, a sleeve located within the bore, the sleeve including a helical channel on an inner surface, mechanical biasing means located between the sleeve and the body to bias the sleeve in a first direction and a ball, sized to run in the helical channel in a reverse direction to prevent a majority of fluid flow through the sleeve and cause the sleeve to move in the reverse direction relative to the body.

Preferably the mechanical bias is a strong spring. The spring may be helical, conical or the like. A strong spring will prevent the sleeve moving in the reverse direction by fluid flow in the central bore.

Preferably the helical channel has curved walls. This will prevent damage to the ball. Preferably also the ball is sized to provide a restricted fluid by-pass around the ball when in the channel. This ensures a positive pressure is maintained behind the ball and prevents chattering of the ball in the channel.

The helical channel may be considered as a screw thread. Thus the channel has a left hand thread so that the ball travels in the opposite direction to the rotation of the tool on a work string. Preferably a pitch of the thread is greater than or equal to a diameter of the ball.

Preferably the ball is spherical. More preferably the ball is of a non-pliable material and thus cannot deform. Advantageously the ball is made of steel.

Preferably also the sleeve includes a conical surface at an entrance to the channel. This funnels the ball into the channel and ensures it travels into the helical path.

BRIEF DESCRIPTION OF THE DRAWINGS

Embodiments of the present invention will now be described, by way of example only, with reference to the following Figures, of which.

DETAILED DESCRIPTION OF THE PREFERRED EMBODIMENTS

Figure 1:
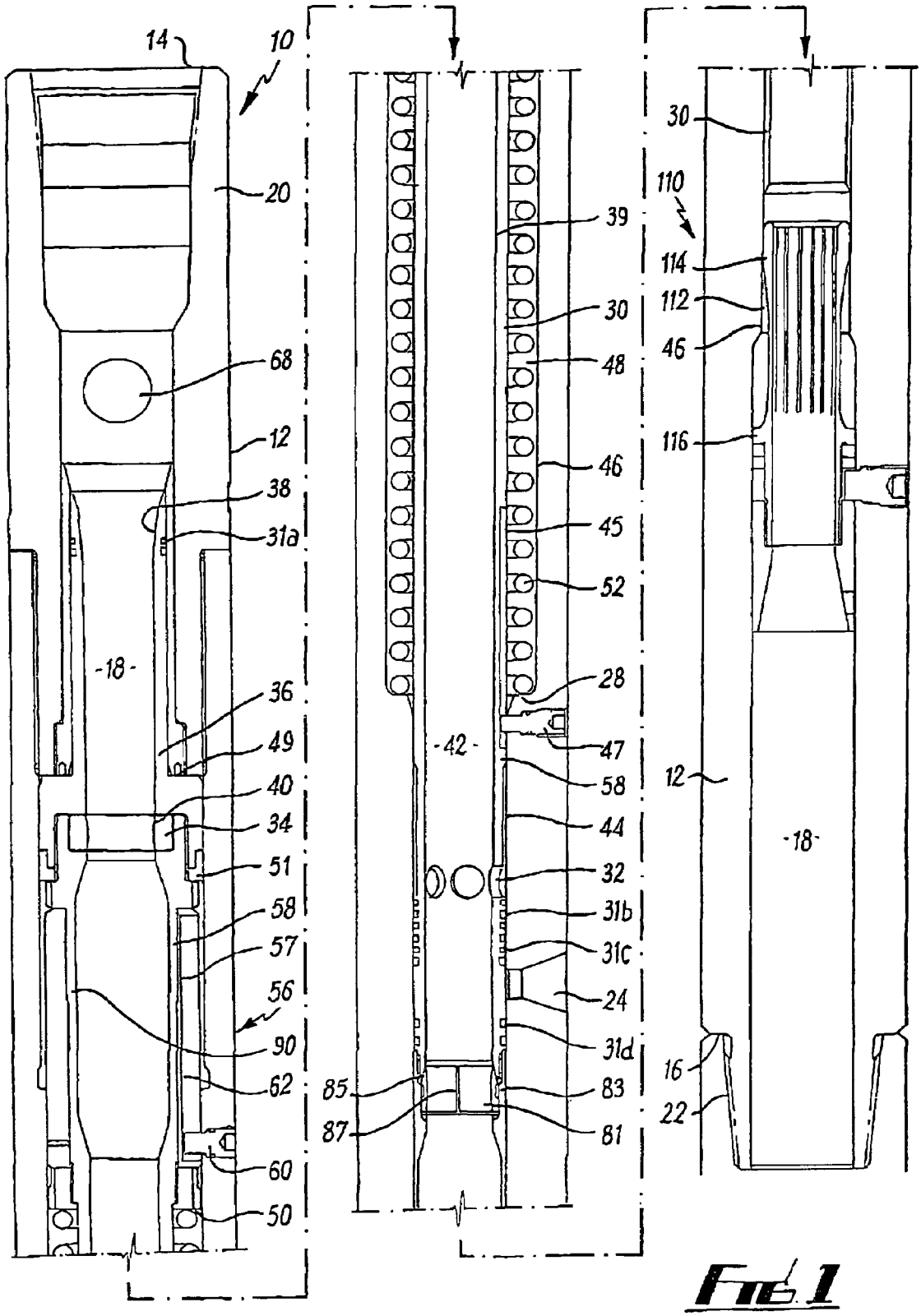
FIG. 1 is a part cross-sectional view of a downhole tool in a first position according to an embodiment of the present invention.

Reference is initially made to FIG. 1 of the drawings which illustrates a downhole tool, generally indicated by reference numeral 10, in accordance with an embodiment of the present invention. Tool 10 includes a cylindrical body 12 having an upper end 14, a lower end 16 and a cylindrical bore 18 running therethrough. The body 12 has a box section 20 located at the upper end 14 and a pin section 22 located at the lower end 16 for connecting the tool 10 in a work string or drill string (not shown).

The body 12 further includes five radial ports 24 located equidistantly around the body 12. The ports 24 are perpendicular to the bore 18.

Within the bore 18 there is located a sleeve 30. Sleeve 30 is an annular body which includes five radial ports 32 located equidistantly around the sleeve 30. The ports 32 are perpendicular to the bore 18. The ports 32 are of a similar size to the ports 24 in the body 12.

On an outer surface 44 of the sleeve 30 there is located a longitudinal recess 45. Arranged through the body 12 is a pin 47 which locates in the recess 45. Relative longitudinal movement of the pin 47 and recess 45 ensures that the ports 24 in the body will align with the ports 32 in the sleeve 30. The sleeve 30 is sealed against body 12 by O-rings 31*a-d* at the ports 24,32.

A ball seat 34 is located on the sleeve 30 at an upper end 36. The ball seat comprises an aperture or throat 40 sized for a ball 68 to rest against and form a seal. The throat 40 also has a diameter less than the diameter of the bore 42 of the sleeve 30. The sleeve includes a conical surface 38 at the upper end 36 to direct the ball 68 with minimal turbulence towards the seat 34.

Located between the outer surface 44 of the sleeve 30 and the inner surface 46 of the body 12 is a space forming a chamber 48. The upper edge of the chamber is formed from a ledge or stop 50 on the outer surface 44 of the sleeve 30. The lower edge of the chamber 48 is formed from the ledge 28 of the body 12. A strong spring 52 is positioned within the chamber 48 and compressed to bias against the ledge 50 of the sleeve 30. A similar chamber 49 can be created between the sleeve 30 and the body 12 at other locations in the tool. The restricted passage of fluid into and through these chambers 48,49 provides a hydraulic damping effect during movement in the tool 10.

Further an engagement mechanism, generally indicated by reference numeral 56, couples the sleeve 30 to the body 12 and controls relative movement therebetween. Engagement mechanism 56 comprises an index sleeve 58, being located with respect to the sleeve 30, and a matching index pin 60 located through the body 12 towards the sleeve 30. Though only one index pin 60 is illustrated the tool 10 would typically have three or more pins to distribute load over the mechanism 56. Index sleeve 58 includes a profiled groove 62 on its outer surface 57 of the sleeve 30 into which the index pin 60 locates.

Figure 2A:
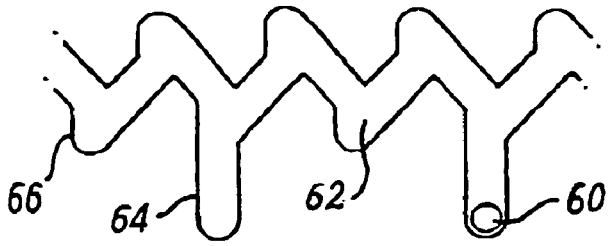
FIGS. 2(*a*)-(*c*) are schematic illustrations of an index pin positioned in a groove of the tool of FIG. 1 for the first, second and third positions respectively.
Figure 2B:
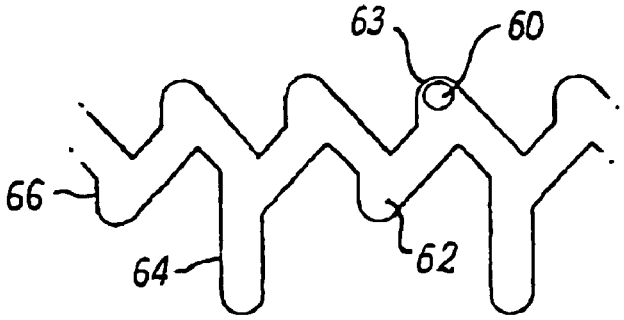
Figure 2C:
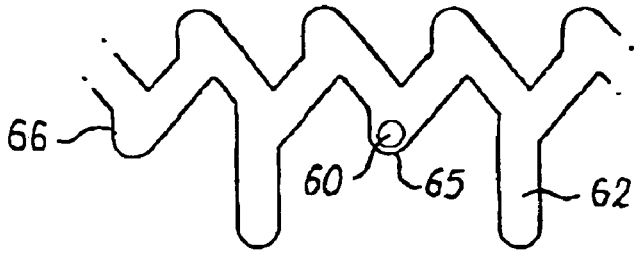

Reference is now made to FIG. 2 of the drawings which illustrates the groove 62 of the index sleeve 58. The groove 62 extends circumferentially around the sleeve 58 and consequently the sleeve 30 in a continuous path. The groove 62 defines a path having a substantially zig-zag profile to provide axial movement of the sleeve 30 relative to the body 12. Indeed, spring 52 biases the sleeve 30 against the index pin 60. The path includes an extended longitudinal portion 64 at every second upper apex of the zig-zag. Further a stop 66 is located at the apexes of the zig-zags to encourage the index pin 60 to remain at the apexes and provide a locking function to the tool 10. The stops 66 are in the direction of travel of the pin 60 along the groove 62.

Further features of the tool 10 will be described hereinafter with reference to later Figures.

In use, tool 10 is connected to a work string using the box section 20 and the pin section 22. As shown in FIGS. 1 and 2(*a*), the spring 52 biases the sleeve 30 against the index pin 60 such that the pin 60 is located in the base of longitudinal portion 64 of the groove 62. This is referred to as the first position of the tool 10. In this position, sleeve ports 32 are located above body ports 24, thus preventing fluid flow radially through these ports due to their misalignment. All fluid flow is through bores 18,42 of the tool 10. The tool 10 is then run into a bore hole until it reaches a location where cleaning of the bore hole casing or circulation of the fluid through the tool is required.

Drop ball 68 is then released through the bore of the work string from the surface. Ball 68 travels by fluid pressure and/or gravity to the ball seat 34 of the sleeve 30. The ball 68 is guided by the conical surface 38 to the ball seat 34. When the ball 68 reaches the seat 34 it effectively seals the bore 12 and prevents axial fluid flow through the tool 10. Consequently fluid pressure builds up behind the ball 68 and the sleeve 30, including the ball 68, moves against the bias of the spring 52, to an intermediate position. The spring 52 is compressed into a now smaller chamber 48. Fluid has been expelled from the chamber 48. The index pin 60 is now located at the apex 63 of the groove 62 next to the longitudinal portion 64. This is as illustrated in FIG. 2(*b*). Consequently the sleeve ports 32 have crossed the body ports 24 and are now located below them. Fluid flow through the bores 18,42 is prevented by the ball 68.

As pressure increases on the ball 68 it is released from the ball seat 34 by passing through the throat 40. The ball 68 travels by fluid pressure until it is stopped further through the tool 10 or the work string. On release of the pressure, spring 52 moves the sleeve 30 against the index pin 60 such that the sleeve travels to a second position. Fluid has been drawn into the chamber 48 and this drawing and expelling of fluid provides a hydraulic damping effect on the impact on the pin 60. Index pin 60 is now located in a base 65 of the groove 62 and the ports 24,32 are aligned. This is illustrated in FIG. 2(*c*). In this second position fluid is expelled radially from the tool 10 through the now aligned ports 24,32. The tool 10 is locked in this position by virtue of the stop 66 on the groove 62 which prevents movement of the sleeve 30 for small variations in fluid pressure.

In order to close the ports 24,32, a second ball is dropped from the surface through the work string. The second ball, and indeed any ball subsequent to this, is identical to the first ball 68. The second ball will travel to rest in the ball seat 34. On the build up of fluid pressure behind the ball, sleeve 30 will move downwards against the bias of the spring 52. Consequently the index pin 60 will be relocated into the next apex 63 of the groove 62 and thus the tool is returned to the intermediate position. When the ball passes through the throat 40, the pin 60 and sleeve 30 will move relatively back to the first position and the ball will come to rest by the first ball 68. The index pin 60 has located in the next longitudinal portion 64. Effectively the tool is reset and by dropping further balls the tool 10 can be repeatedly cycled in an open and closed manner as often as desired. The intermediate position can be considered as a primed position.

It will be appreciated that although the description refers to relative positions as being 'above' and 'below', the tool of the present invention can equally well be used in horizontal or inclined boreholes and is not restricted to vertical boreholes.

Figures 3A, 3B, 3C:
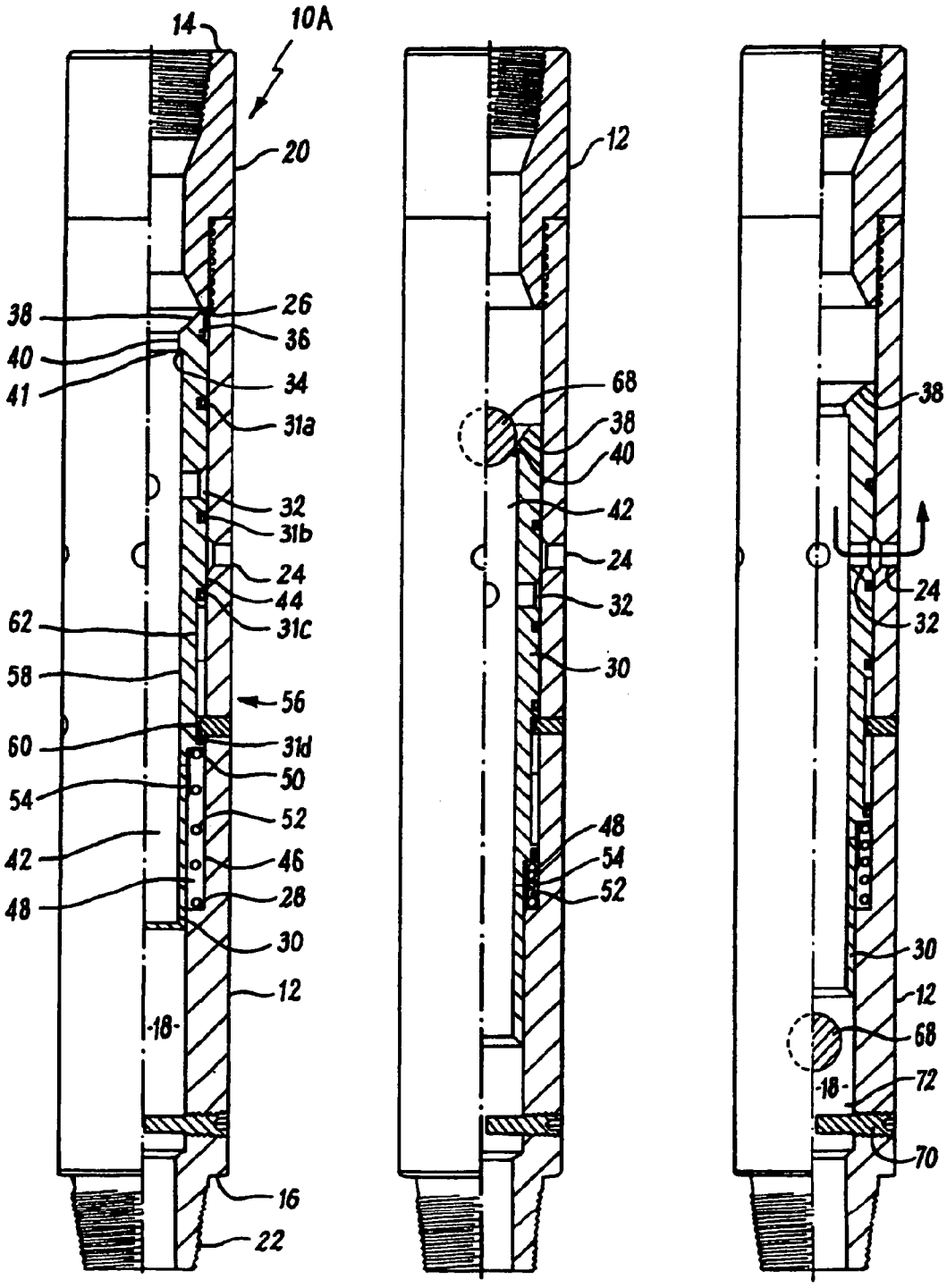
FIGS. 3(*a*)-(*c*) are part cross-sectional views of a downhole tool according to a further embodiment of the present invention illustrating a change in operating position from (a) a first operating position to (c) a second operating position.

Reference is now made to FIG. 3 of the drawings which illustrates a downhole tool, generally indicated by reference numeral 10A, in accordance with a further embodiment of the present invention. Tool 10A has similar features to the tool 10 of FIG. 1 and those features have been given the identical reference numerals for ease of interpretation. Tool 10A is a circulation tool operated by the alignment of the radial ports 24,32 of the sleeve 30 and the body 12. Movement is controlled via an engaging mechanism 56, as for FIGS. 1 and 2.

In this embodiment, located on an inner surface of the body 12 are two opposing ledges 26, 28 used to limit axial movement of the sleeve 30 located within the body 12. The ball seat 34 is located on the sleeve 30 at an upper end 36. The ball seat comprises a conical surface 38 facing the upper end 14 of the tool 10A. A throat 40 is provided at a base of the conical surface 38, the throat having a diameter less than the diameter of the bore 42 of the sleeve 30.

Located between the outer surface 44 of the sleeve 30 and the inner surface 46 of the body 12 is a chamber 48. An exhaust port 54 is located through the sleeve 30 at the chamber 48 to allow fluid from the bore 42 to pass in to and out of the chamber 48 as the sleeve 30 is moved relative to the body 12.

FIG. 3(*a*) illustrates the tool 10A when run into a well bore. FIG. 3(*b*) illustrates the tool 10A with a ball 68 located in the bore 42. Ball 68 is sized to rest on surface 38 and of a deformable material e.g. rubber so that under force it changes shape within its own volume to pass through the throat 40. FIG. 3(*c*) of the drawings illustrates the tool 10A with the ball 68 exiting the sleeve 30 into the bore 18. Body 12 includes a pin 70 located into the bore 18. Pin 70 is a ball retainer pin which blocks the passage of the ball 68 through the bore 18. Ball 68 will come to rest at the pin 70 and is therefore retrievable with the tool 10A. Pin 70 does not prevent the flow of fluid through the bore 18 and from the tool 10A into the work string below. The pin 70 and the space 72 in the bore 18 immediately above it may be considered as a ball catcher.

In use, tool 10A operates as for the tool described in FIGS. 1 and 2. Drop ball 68 travels by fluid pressure and/or gravity to the ball seat 34 of the sleeve 30. The ball 68 rests on the conical surface 38 and prevents axial fluid flow through the tool 10A. Consequently fluid pressure builds up behind the ball 68 and the sleeve 30, including the ball 68, moves against the bias of the spring 52, to the intermediate position. This position is illustrated in FIG. 3(*b*). The spring 52 is compressed into a now smaller chamber 48. Fluid has been expelled from the chamber 48 through the exhaust port 54. The index pin 60 is now located at the apex 63 of the groove 62. Consequently the sleeve ports 32 have crossed the body ports 24 and are now located below them. Fluid flow is prevented form passing through the bores 18,42, by the obstruction of the ball 68.

As pressure increases on the ball 68 it is extruded through the throat 40 by deforming. The ball 68 travels by fluid pressure until it is stopped by the pin 70 and is held in the space 72. On release of the pressure, spring 52 moves the sleeve 30 against the index pin 60 such that the sleeve travels to the second position. The second position is illustrated in FIG. 3(*c*). Fluid has been drawn into the chamber 48 and this drawing and expelling of fluid provides a hydraulic damping effect on the impact on the pin 60. Index pin 60 is now located in the base 65 of the groove 62 and the ports 24,32 are aligned. In this third position fluid is expelled radially from the tool 10A through the now aligned ports 24,32. The tool 10A is locked in this position by virtue of the stop 66 on the groove 62 which prevents movement of the sleeve 30 for small variations in fluid pressure.

In order to close the ports 24,32, a second ball is dropped from the surface through the work string. The second ball, and indeed any ball subsequent to this, is identical to the first ball 68. The second ball will travel to rest in the ball seat 34. On the build up of fluid pressure behind the ball, sleeve 30 will move downwards against the bias of the spring 52. Consequently the index pin 60 will be relocated into the next apex 63 of the groove 62 and thus the tool is returned to the intermediate position. When the ball is extruded through the throat 40, the pin 60 and sleeve 30 will move relatively back to the first position and the ball will come to rest by the first ball 68. Effectively the tool is reset and by dropping further balls the tool 10A can be repeatedly cycled in an open and closed manner as often as desired.

Figures 4A, 4B, 4C:
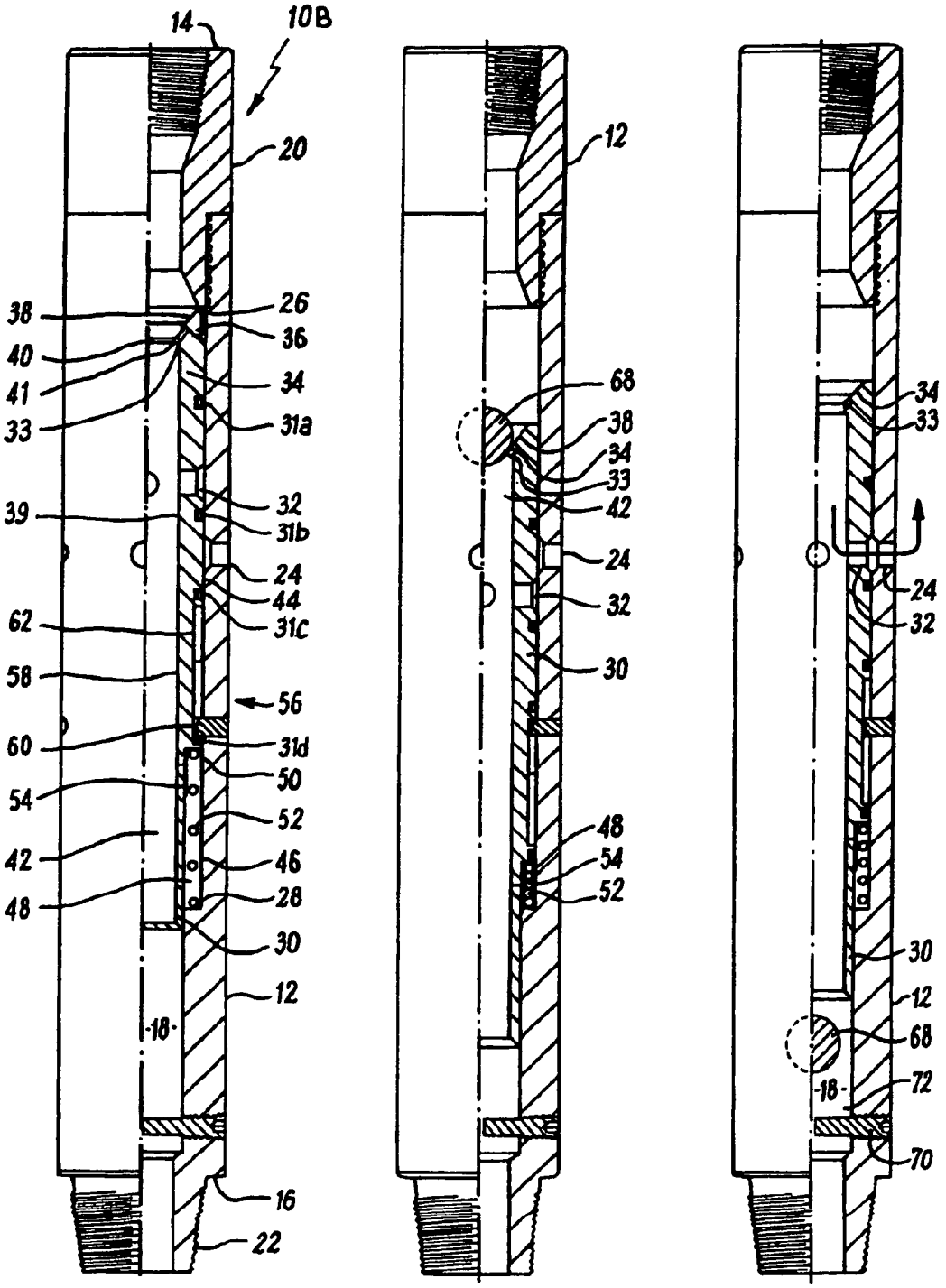
FIGS. 4(*a*)-(*c*) are part cross-sectional views of a downhole tool according to a still further embodiment of the present invention illustrating a change in operating position from (a) a first operating position to (c) a second operating position.

Reference is now made to FIG. 4 of the drawings which illustrates a downhole tool, generally indicated by reference numeral 10B, in accordance with a still further embodiment of the present invention. Tool 10B includes features in common with the tool illustrated in FIG. 3 and thus like parts have been given the same reference numerals to aid clarity. Tool 10B is a circulation tool operated by the alignment of the radial ports 24,32 of the sleeve 30 and the body 12. Movement is controlled via an engaging mechanism 56 as for FIGS. 1 and 2.

In this second embodiment, ball seat 34 is a deformable ball seat. The seat 34 is located at an upper end 36 of the sleeve 30. A conical surface 38 of the seat 34 faces the upper end 14 of the tool 10B. The conical surface 38 is part of a disc spring 33 mounted at the upper end 36 of the sleeve 30. A perpendicular portion 41 of the spring 33 sits proud of the inner surface 39 of the sleeve 30. The spring 33 is placed in the first direction such that it operates opposite to its typical arrangement. Spring 33 may comprise a stack of disc springs selected to provide a deflection or flex in structure at a desired pressure. Disc springs, and in particular disc springs formed from conical shaped washers (sometimes referred to as Belleville washers) as used here, are well known to those skilled in the art. Such springs are available from, for example, Belleville Springs Ltd, Redditch, United Kingdom. An advantage of these springs is that they return to their original shape following deflection.

FIG. 4(*a*) illustrates the location of the ball seat 34 as the tool is run in a well bore. The tool 10B is in a first operating position with the radial ports 24,32 misaligned and the sleeve 30 biased fully upwards by the spring 52. FIG. 4(*b*) illustrates the tool 10B with a ball 68 now located in the bore 42. Ball 68 is located on the deformable ball seat 34 and is sized to block the bore 42. In this way the ball 68 is arrested and pressure builds up behind the ball 68. This pressure moves the ball 68 and sleeve 30 together within the body 12 to the position illustrated. At this point the spring 52 is compressed fully, this being the maximum distance of travel for the sleeve 30. Any additional pressure will now cause the disc spring 33 to flex and release the ball to travel through the sleeve 30 and into the bore 18.

The ball is of a hard material which is non-pliable. Ideally the ball is made of a metal such as steel.

Reference is now made to FIG. 4(*c*) which illustrates the tool 10B with the ball 68 now exiting the sleeve 30 into the bore 18. Exit of the ball is in an identical manner to that of FIG. 3(*c*).

In use, tool 10B operates identically to the earlier tools. Ball 68 travels by fluid pressure to the conical surface 38 at the upper end 36 of the sleeve 30. The ball 68 lands on the seat 34 where its progress is arrested. As the ball 68 is now blocking the fluid flow through the bore 42, fluid pressure will build up behind the ball and allows sufficient pressure to build up on the ball 68 and sleeve 30 such that they can move in the direction of applied pressure against the bias of the spring 52. Consequently the sleeve 30 and ball 68 move to an intermediate position. This position is illustrated in FIG. 4(*b*). On increasing fluid pressure on the ball 68, with the sleeve 30 now arrested, pressure is exerted on the ball seat 34. The disc spring 33 will deflect under this increased pressure and ejects the ball 68 into the bore 42 below the seat 34. The seat 34 has deformed within its own volume and now returns to its original shape. The ball 68 exits the seat 34 and free falls from this point. On release of the pressure, spring 52 moves the sleeve 30 against the index pin 60 such that the sleeve travels to a second position. The second position is illustrated in FIG. 4(*c*). The ports 24,32 are aligned for fluid to be expelled radially from the tool 10B.

In order to close the ports 24,32, a second ball is dropped from the surface through the work string. As with the previous embodiments the tool 10B is reset and can be cycled between the first and second operating position a number of times. The number of times may be dependent on the number of balls which can be caught in the work string.

Figures 5A, 5B, 5C:
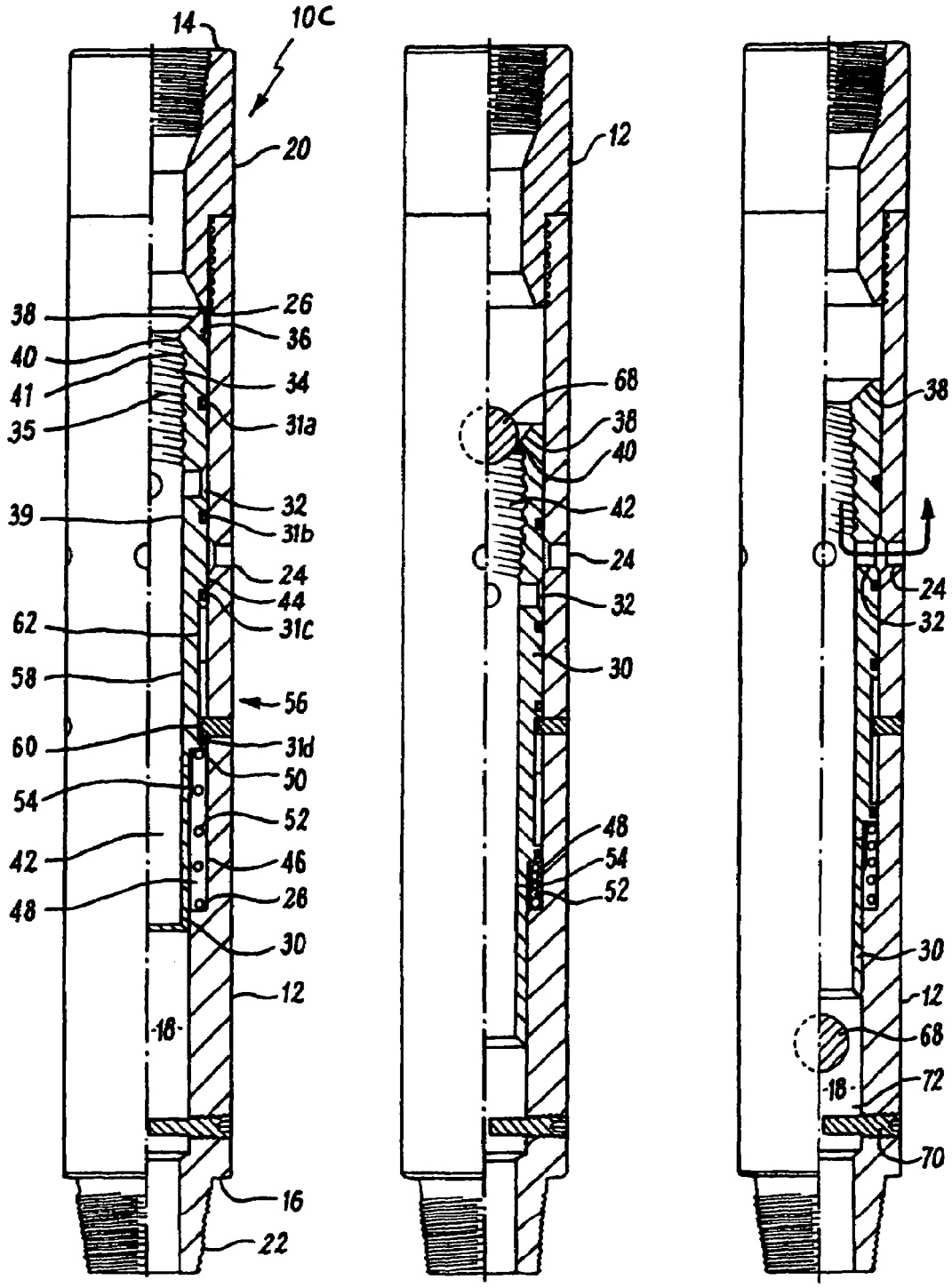
FIGS. 5(*a*)-(*c*) are part cross-sectional views of a downhole tool according to a yet further embodiment of the present invention illustrating a change in operating position from (a) a first operating position to (c) a second operating position.

Reference is now made to FIG. 5 of the drawings which illustrates a downhole tool, generally indicated by reference numeral 10C, in accordance with a yet further embodiment of the present invention. Tool 10C has identical features and operates in an identical manner to the earlier embodiment except that it incorporates an alternative ball seat 34 comprising a helical channel 35.

At an upper end 36 of the sleeve 30 is located a conical surface 38 facing the upper end 14 of the tool 10C. Downwardly extending from the conical surface is a helical channel 35. The channel 35 comprises a continuous spiral groove, having curved walls 41, which takes the path of a screw thread on the inner surface 39 of the sleeve 30. The handedness of the 'screw thread' is left handed.

FIG. 5(*b*) illustrates the tool 10C, now with a ball 68 located in the bore 42. Ball 68 is sized to travel along the helical channel 35. Ideally the ball 68 is sized to have a diameter less than or equal to the pitch of the screw thread forming the walls 41 of the channel 35. In this way when the ball 68 travels along the channel 35 a restricted by-pass is created between the edge of the ball 68 and the walls 41 of the channel 35. The ball is of a hard material which is non-pliable. Ideally the ball is made of a metal such as steel.

In use, tool 10C is connected to a work string and run in a well bore in a first operating position as shown in FIG. 5(*a*), until it reaches a location where cleaning of the bore hole casing or circulation of fluid through the tool is required.

Drop ball 68 is then released through the bore of the work string from the surface of the well bore. Ball 68 travels by fluid pressure and/or gravity to the conical surface 38 at the upper end 36 of the sleeve 30. The ball 68 is funneled into the helical channel 35 where its progress is arrested. As the ball 68 is now blocking the majority of fluid flow through the bore 42, fluid pressure will build up behind the ball and force the ball along the helical channel 35. Due to the size of the ball a small amount of fluid will be allowed to by-pass the ball 68. This restrictive fluid by-pass ensures that a positive pressure is maintained behind the ball 68 so that the ball 68 does not flow towards the upper end 14 of the tool 10C also prevents the ball 68 from 'chattering' in the channel 35. As the ball 68 makes its way along the channel 35 it acts as a temporary flow restrictor allowing sufficient pressure to build up on the ball 68 and sleeve 30 such that they can move in the direction of applied pressure against the bias of the spring. Consequently the sleeve 30 and ball 68 move to the intermediate position. This position is illustrated in FIG. 5(*b*). Though the ball 68 is at the top of the channel 35 it will be appreciated that this position can be reached with the ball in this position or when the ball 68 has traveled a distance down the channel 35.

On reaching the base of the channel 35, at the sleeve port 32, the ball 68 exits the channel 35 and free falls from this point. The tool then moves to the second operating position as described with reference to the previous figures.

As with the earlier embodiments, the tool can be reset and operated in a cyclic manner by the repeated insertion of identical balls 68 into the bore 42.

Returning to FIG. 1, the tool of the present invention can advantageously include a number of further features.

In the embodiment of FIG. 1, there is included a choke ring 51. This lies between the sleeve 30 and the body 12. Alternatively it could form a portion of either the sleeve 30 or the body 12. The ring comprises an elongate, cylindrical portion having at an end a substantially longitudinal portion to provide an 'L' cross section. The ring 51 is arranged close to the sleeve 30 and the body 12 to provide a restricted flow path therebetween. The presence and shape of the ring 51 assists in providing a damping action as the sleeve moves in the reverse direction. Fluid, which has to pass the sleeve as it moves downwards is forced to take the restricted flow path in the first direction. This damping helps prevent the mechanical bias e.g. a spring or other parts of the tool 10, from 'bouncing' into a location which could result in the functional means being moved to an unwanted operating position.

A split ring 81 is also located in the bore 42 of the tool 10. This ring 81 is located below the ports 24,32. The ring 81 is housed in a recess 83 formed on the inner surface 39 of the sleeve 30. The recess 83 includes a conical portion 85 which provides a ramp whose apex is directed toward the ball seat 34. The ring 81 and recess 83 are sized such that the ball 68 can pass easily therethrough as it passes through the sleeve 30 from the upper end 14 to the lower end 16 of the tool 10. However if the ball 68 is, at any time, directed back up the tool 10 the ring 81 will prevent its passage. The ball 68 will be influenced by varying fluid pressure and by turbulence within the bore 42 and these may cause the ball 68 to change direction. If the ball 68 changes direction and heads upwards it will contact the ring 81. The ring 81 will be moved up the ramp and consequently edges at the split 87 will be brought together as the bore 42 is restricted. The diameter of the ring 81 will decrease sufficiently to a point where it is smaller than the diameter of the ball 68. At this point the ball 68 will stick at the ring 81 and its passage up the bore 42 is prevented. This provides a one-way or non-return feature for the ball 68 within the tool 10.

Figure 6:
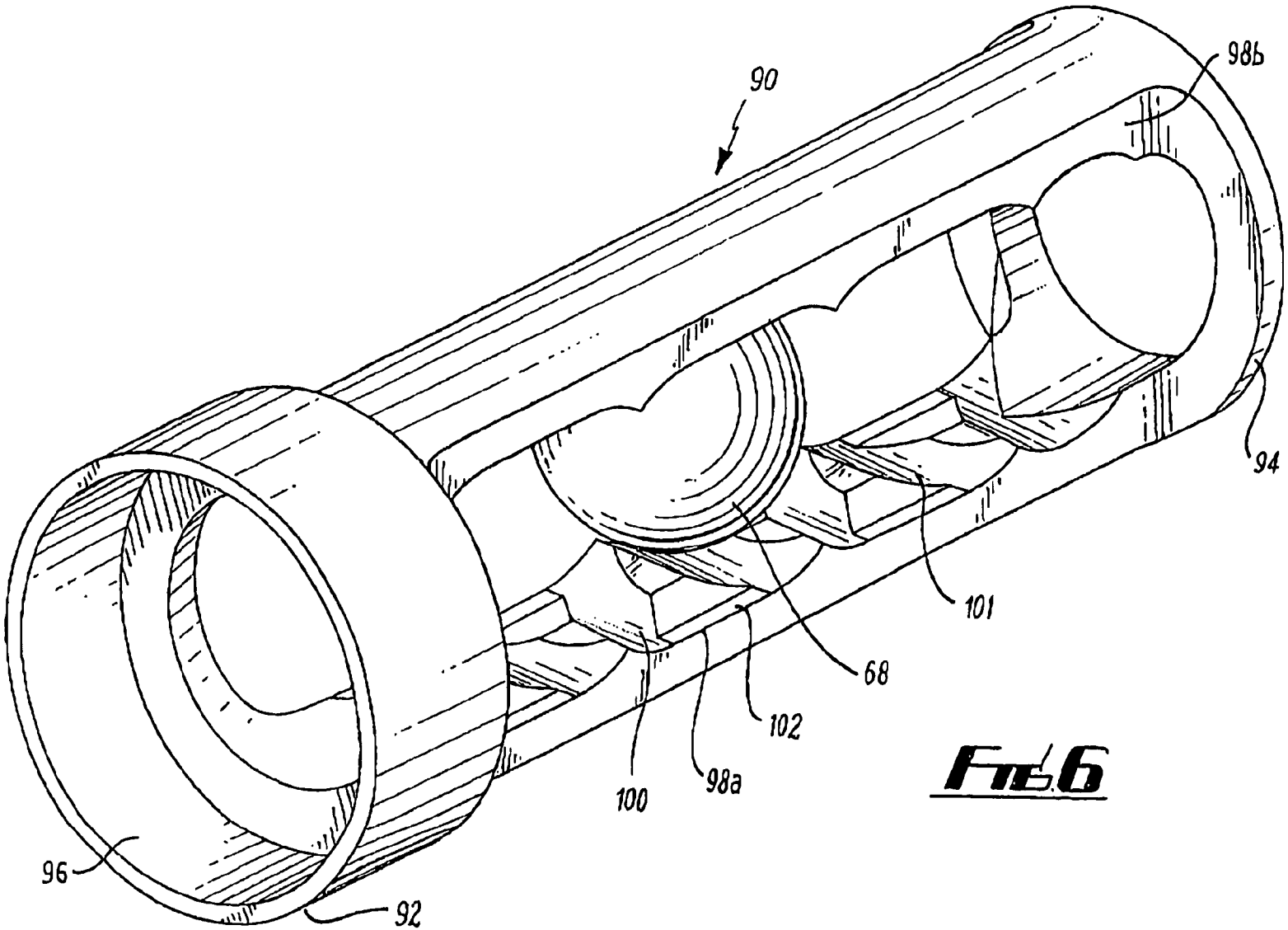
FIG. 6 is a schematic view of a ball arrester according to a yet further embodiment of the present invention.

A problem encountered in drop ball activated downhole tools is that when a ball is released from a ball seat it can have a significant force associated with it. A ball travelling through a work string at high velocity can have sufficient kinetic energy and resulting momentum to explode through any further restraining apertures in the work string. This prevents certain types of drop-ball activated tools, such as those with expandable or deformable ball seats, being located close to each other on a work string and limits the design of some ball catchers. A ball arrester 90 is located in the tool 10 to prevent this. The arrester 90 can be formed as part of the sleeve 30 below the ball seat 34 or can be mounted on the sleeve 30 below the ball seat 34. An embodiment of a ball arrester is shown in FIG. 6. The arrester 90 has an upper end 92 and a lower end 94. At the upper end 92 there is a recess 96 into which a ball seat 34 may be located.

As illustrated the arrester may comprise one or more inner surfaces 98 longitudinally arranged between the ends 92,94. In the embodiment shown two surfaces 98*a*,*b* are provided. Such an arrangement is easier to machine. On each inner surface 98 there is located a number of transverse ledges 100. Each ledge 100 has a trailing ramp 101 towards the lower end 94. The trailing ramp 101 is concave thereby providing a curvature. This curvature guides a ball 68 along the ledge 100.

Additionally longitudinally arranged slots or recesses 102 lie perpendicular to the ledges 100 opposing ends of adjacent ledges 100. The ledges 100 and the slots 102 together define a path through the arrester 90. The path is convoluted in that a ball 68 travelling through the arrester 90 is forced to make each transverse crossing before it can fall downwards through the sleeve 30. Each impact of the ball on a ledge 100 slows the ball down and its energy is consequently dissipated through the arrester 90.

The path through the arrester 90 is sized such that fluid may pass around the ball 68 during its passage. In this way, the pressure on the ball 68 as it passes through the seat is dissipated before the ball reaches any further ball seats in a tool or in the work string to which it is attached. This prevents a ball 'exploding' through restrictions in the bore and allows restrictions, such as further ball seats, to be mounted relatively closely to the ball seat 34.

Returning again to FIG. 1 there is illustrated a second ball seat, generally indicated by reference numeral 110, according to an embodiment of the present invention. The second ball seat 110 is located towards a lower end 16 of the tool 10, below the sleeve 30. In this embodiment the second ball seat 110 is a collet 112, as is known in the art. Collet 112 comprises twelve fingers 114 which are arranged longitudinally in the bore 18. Any number of fingers 114 could be used. The fingers 114 are fixed at a base by being integral with a sleeve 116. The sleeve 116 is held to the body 12 so that the collet 112 cannot move longitudinally in the bore 12. The collet 112 is sized so that the fingers 114 rest on the inner surface 46 of the body 12. Each finger 114 has a curved upper edge so that the sleeve 30 can be pushed over the fingers 114. Thus downward movement of the sleeve 30 will cause the sleeve to be pushed between the collet 112 and the body 12. When the sleeve 30 is around the collet 112, the fingers 114 are forced radially inwardly and consequently the bore 18 is restricted in diameter at this point.

In use, when the tool 10 is moved to the second operating position, the sleeve 30 will be pushed down against the collet 112 and sit between the collet 112 and the body 12. Thus as the ball 68 arrives at the collet 112 the clearance through the bore 12 will have been reduced and there will be insufficient space for the ball 68 to pass there through. As a result the ball 68 will be held in the second ball seat 110. Fluid passing through the bore 18 will be substantially prevented from passing the ball seat 110. Axial fluid flow is substantially prevented and this will ensure all fluid flow is through the radial ports 24,32. When a further ball is released into the tool 10, this will cause the sleeve to move back towards the top 14 of the bore 18 and thus the collet 112 is released and the first ball 68 will fall through the tool 10. As the sleeve 30 begins to move towards the top 14, the second released ball will fall and hit the first ball. As the sleeve continues to move the second ball seat 110 opens sufficiently to release both balls.

An alternative embodiment for the second ball seat could be a trapped 'C' ring, or split ring. This would work in a similar way to the non-return split ring 81 presented earlier. The ramp would be replaced by the sleeve 30 moving down towards the ring. The end of the sleeve would be shaped to slide in behind the ring. Again movement of the sleeve between the ring and the body will cause the ring to be compressed wherein its diameter reduces. A ball will therefore be prevented from passing through the bore and be stopped at the ring. Movement of the sleeve in the first direction will free the ring and, by expansion, the ball can pass through the now increased aperture.

Figure 7A:
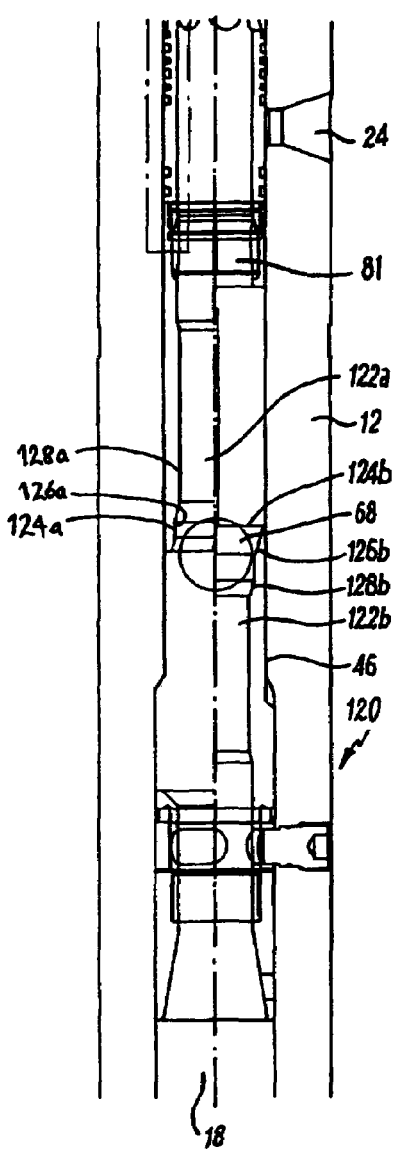
FIGS. 7(*a*)-(*c*) are part cross-sectional views of a downhole tool according to an embodiment of the present invention showing a ball seat of the tool and illustrating a change in operating position from (a) a first operating position to (c) a second operating position.
Figure 7B:
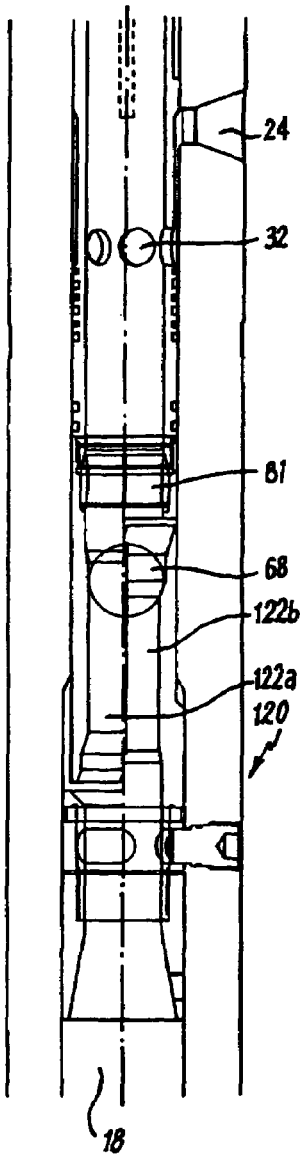
Figure 7C:
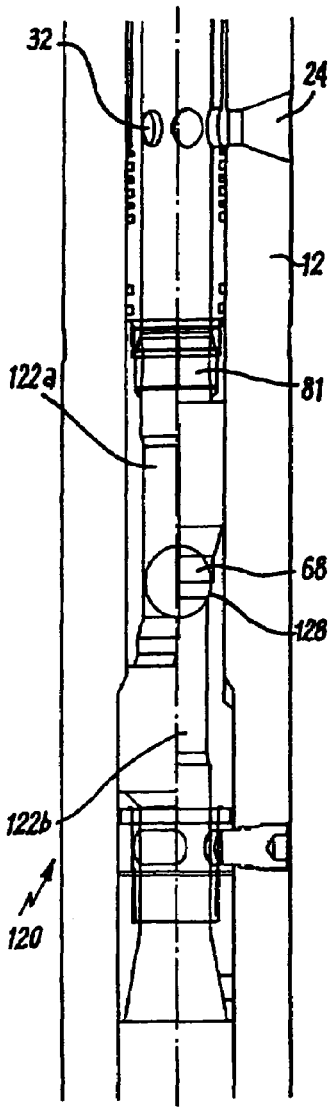

A further embodiment of the second ball seat 110 is illustrated in FIG. 7. Like parts to those of FIG. 1 have been given the same reference numeral to aid clarity. Advantageously the second ball seat of this embodiment is a shuttle arrangement, generally indicated by reference numeral 120. The shuttle arrangement 120 comprises two semi-cylindrical sleeves 122*a,b*. The sleeves 122 combine to form a complete sleeve which is located in the body 12. One sleeve 122*a* is connected to the sleeve 30 and thus moves with the sleeve 30. The other sleeve 122*b* is fixed to the body 12 towards the lower end 16. The sleeves 122*a,b* are arranged to overlap in the bore at all times, such that movement of the sleeve brings them into sliding engagement. The sleeves 122*a,b* are sized such that, when the sleeves 122*a,b* are brought together, the internal bore created has a diameter smaller than the diameter of the balls 68, but that a ball 68 can pass between a sleeve 122*a,b* and the inner surface 46 of the body 12. A free end 124*a,b* of each sleeve 122*a,b* includes a funnel portion 126*a,b* which presents a ledge or ramp 128*a,b* towards the free end 124*a,b*. The ledge 128*a,b* acts as a ball seat if the clearance through the arrangement 120 is insufficient for a ball 68 to pass.

In use, the tool 10 will be run in the well bore with the sleeves 122*a,b* furthest from each other as the sleeve 30 is towards the top 14 of the tool 10. Funnel portions 126*a,b* overlap and provide a clearance which is greater than the diameter of a ball 68. This provides maximum fluid flow through the tool 10 during run-in. This is illustrated in FIG. 7(*a*). When a ball 68 is located in the ball seat 34, the sleeve 30 is forced downwards and consequently the sleeves 122*a,b* are shuttled together in to a substantially overlapping position. Clearance between the sleeves 122*a,b* is now reduced and a ball would be prevented from passing therethrough as it will be held on the lower ledge 128*b*. This is as illustrated in FIG. 7(*b*). When the ball 68 is released from the ball seat 34 it travels towards the arrangement 120 while the sleeve and consequently the upper sleeve 112*a* move upwards by a distance determined by the index sleeve 58. They come to rest at a position illustrated in FIG. 7(*c*). At this position the ball 68 is caught on the ledge 128 as there is insufficient clearance through the arrangement 120. It will be clear that by dropping a second ball through the tool, the sleeve is moved to the position illustrated in FIG. 7(*a*) wherein the funnel portions 126*a,b* meet to provide an aperture through which both balls can exit the tool 10.

The principal advantage of the present invention is that it provides a downhole tool which can be repeatedly operated by dropping identical balls through the work string. A further advantage is that it provides a circulation tool which can have a number of radial ports to increase the flow area if desired compared with the prior art.

Further as the actuating mechanism is located above the ports, the ports are opened with no flow going across the seals. This effectively saves the seals from excessive wear. An additional advantage is in the ability of the index sleeve to lock the circulating ports in position when aligned. Yet further the entry and exit of fluid in the chamber for the spring advantageously reduces the impact on the index pin via a hydraulic damping effect.

The incorporation of a ball non-return element advantageously prevents balls travelling back through the tool, while a lower ball seat allows selective blocking of the axial bore, for instance, when radially circulating fluid. Yet further the use of a ball arrester allows the ball seats to be mounted close together, thus reducing the length of the tool.

Various modifications may be made to the invention herein described without departing from the scope thereof. For example, more index pins could be used to provide increased stability to the tool and distribute the load on the pins. Additional radial ports could be located at longitudinal spacings on the tool to provide radial fluid flow across a larger area when the ports are open. The ports may have varying diameters which may provide a nozzle on the outer surface of the body to increase fluid velocity.

The invention claimed is:

1. A downhole tool for selectively performing a task in a well bore, the tool comprising a substantially cylindrical body having a central bore running axially therethrough, a sleeve located within the bore, the sleeve including a ball seat, a plurality of balls, each ball having substantially similar dimensions and each ball arresting a majority of fluid flow through the bore when located in the ball seat, mechanical biasing means located between the sleeve and the body to bias the sleeve in a first direction, and functional means on the body to perform a task in the well bore, the functional means being operable on relative movement of the sleeve, wherein the functional means has at least a first and a second operating position, each change in position being effected by passing a said ball through the sleeve in a reverse direction, and wherein the said changes form a cyclic pattern such that the functional means can be cycled back to the first operating position.

2. A downhole tool as claimed in claim 1 wherein the ball seat releasably retains each ball.

3. A downhole tool as claimed in claim 1 wherein the balls are deformable.

4. A downhole tool as claimed in claim 1 wherein the ball seat is a deformable ball seat which flexes to release the ball.

5. A downhole tool as claimed in claim 4 wherein the deformable ball seat comprises a spring such as a disc spring.

6. A downhole tool as claimed in claim 1 wherein the ball seat comprises a helical channel on an inner surface of the sleeve.

7. A downhole tool as claimed in claim 4 wherein the balls are of a non-pliable material and thus cannot deform.

8. A downhole tool as claimed in claim 1 wherein the mechanical biasing means is a strong spring.

9. A downhole tool as claimed in claim 1 wherein a chamber exists between the sleeve and the body which acts as a damper during movement of the sleeve relative to the body.

10. A downhole tool as claimed in claim 1 wherein a choke ring is located around the sleeve to provide a damping action by forcing passing fluid to slow down as the sleeve moves relative to the tool body.

11. A downhole tool as claimed in claim 1 wherein the tool further comprises engagement means to control relative movement between the sleeve and the body.

12. A downhole tool as claimed in claim 11 wherein said engagement means comprises at least one index pin located in a profiled groove which extends around the tool.

13. A downhole tool as claimed in claim 1 wherein the tool further includes a ball non-return element.

14. A downhole tool as claimed in claim 13 wherein the element is a split ring located on a ramp within the bore.

15. A downhole tool as claimed in claim 1 wherein the tool includes a ball arrester.

16. A downhole tool as claimed in claim 15 wherein the arrester comprises a plurality of surfaces transversely arranged to the central bore to provide a convoluted path which a ball must take through the sleeve.

17. A downhole tool as claimed in claim 1 wherein the tool further comprises a second ball seat, located below the sleeve.

18. A downhole tool as claimed in claim 17 wherein the second ball seat comprises a collet including a plurality of fingers directed in the first direction operated by the sleeve.

19. A downhole tool as claimed in claim 17 wherein the second ball seat comprises a trapped 'C' ring.

20. A downhole tool as claimed in claim 17 wherein the second ball seat is a shuttle arrangement, wherein the relative position of shuttle elements provide a seat to prevent passage of a ball.

21. A downhole tool as claimed in claim 1 wherein the tool is a circulation tool.

22. A downhole tool as claimed in claim 21 wherein the functional means comprises at least one first port arranged substantially transversely to the central bore through the body, and at least one second port arranged transversely to the central bore through the sleeve, such that alignment of the ports causes fluid to be discharged from the central bore and wherein alignment of the ports is controlled by relative movement of the sleeve.

23. A downhole tool as claimed in claim 1 wherein the tool includes ball collecting means.

24. A method of circulating fluid in a borehole, the method comprising the steps:

(a) inserting in a work string a tool comprising a tubular body including a plurality of first radial outlets in which is located a sleeve including a plurality of second radial outlets;

(b) running the work string and tool into a borehole, with the sleeve in a first position relative to the body wherein the first and second radial outlets are arranged in a first operating position;

(c) dropping a ball into the work string such that the ball lands on the sleeve and forces the sleeve into a second position relative to the body wherein the first and second radial outlets are arranged in an intermediate operating position and fluid flow is restricted by the ball; and (d) increasing pressure behind the ball to cause the ball to pass through the sleeve, the releasing of pressure caused by the ball passing through the sleeve thereby allowing the sleeve to move to a third position relative to the body wherein the first and second radial outlets are arranged in a second operating position; and wherein the ports are aligned in a either of the operating positions and misaligned in the other operating position.

25. A method as claimed in claim 24 wherein the method further includes the steps of:

(a) dropping a second ball, identical to the first ball, into the work string such that the second ball lands on the sleeve and forces the sleeve into the second position relative to the body wherein the first and second radial outlets are arranged in the intermediate operating position and fluid flow is restricted by the second ball; and (b) increasing pressure behind the second ball to cause the second ball to pass through the sleeve, the releasing pressure allowing the sleeve to move to the first position relative to the body wherein the first and second radial outlets are arranged in the first operating position.

26. A method as claimed in claim 24 wherein the method includes the step of moving the sleeve against a mechanical bias.

27. A method as claimed in claim 24 wherein the method includes the step of controlling movement of the sleeve relative to the body by use of an index sleeve.

28. A method as claimed in claim 24 wherein the method includes the step of decelerating the ball as it passes from the sleeve to dissipate the pressure.

29. A method as claimed in claim 24 wherein the step of dropping a ball into the work string comprises dropping the ball such that the ball lands on a first ball seat of the sleeve, and wherein the method includes the further step of stopping the ball in a second ball seat after it has passed through the sleeve.

30. A method as claimed in claim 29 wherein the method further includes the step of preventing fluid flow through the work string while directing it through the radial ports.

31. A method as claimed in claim 24 wherein the method includes the step of catching the dropped balls in the work string.

32. A ball arrester for dissipating momentum of a ball after it has passed through a ball seat, the arrester comprising a substantially cylindrical body in which is located a non-linear pathway through which the ball is guided.

33. A ball arrester as claimed in claim 32 wherein the pathway comprises a plurality of surfaces transversely arranged to a central bore.

34. A ball seat for a downhole tool, the ball seat comprising a sleeve formed from a plurality of part cylindrical sleeves which can shuttle with respect to each other, longitudinally in the tool, wherein a ball can only pass through the seat when the part cylindrical sleeves are located at their longitudinal extent.

35. A ball seat for a downhole tool as claimed in claim 34 wherein at least a first part cylindrical sleeve is stationary while at least a second part cylindrical sleeve moves relative thereto.

36. An actuation mechanism for a downhole tool, the mechanism comprising a substantially cylindrical body having a central bore running axially therethrough, a sleeve located within the bore, the sleeve including a deformable ball seat, mechanical biasing means located between the sleeve and the body to bias the sleeve in a first direction and a ball, wherein the deformable ball seat releasably retains the ball to prevent fluid flow through the sleeve and cause the sleeve to move in the reverse direction relative to the body and wherein on release of the ball the seat returns to its original dimensions.

37. An actuation mechanism as claimed in claim 36 wherein the ball seat comprises a spring.

38. An actuation mechanism as claimed in claim 37 wherein the spring is a plurality of disc springs in a layered structure.

39. An actuation mechanism for a downhole tool, the mechanism comprising a substantially cylindrical body having a central bore running axially therethrough, a sleeve located within the bore, the sleeve including a helical channel on an inner surface, mechanical biasing means located between the sleeve and the body to bias the sleeve in a first direction and a ball, sized to run in the helical channel in a reverse direction to prevent a majority of fluid flow through the sleeve and cause the sleeve to move in the reverse direction relative to the body.

40. An actuation mechanism as claimed in claim 39 wherein the mechanical bias is a strong spring.

41. An actuation mechanism as claimed in claim 39 wherein the helical channel has a left hand thread so that a ball travelling through the seat travels in the opposite direction to the rotation of the work string.

42. An actuation mechanism as claimed in claim 41 wherein a pitch of the thread is greater than or equal to a diameter of the ball intended to pass therethrough.

43. A method of circulating fluid in a borehole, the method comprising the steps:

(a) inserting in a work string a tool comprising a tubular body including a plurality of first radial outlets in which is located a sleeve including a plurality of second radial outlets;

(b) biasing the sleeve in a first direction towards a first position relative to the body wherein the first and second radial outlets are arranged in a first operating position;

(c) running the work string and tool into a borehole, with the sleeve in the first position;

(d) dropping a first ball into the work string such that the ball lands on the sleeve and forces the sleeve in a direction reverse to said first direction into a second position relative to the body wherein the first and second radial outlets are arranged in an intermediate operating position and fluid flow is restricted by the ball;

(e) increasing pressure behind the first ball to cause the first ball to pass through the sleeve, the releasing pressure allowing the sleeve to move to a third position relative to the body wherein the first and second radial outlets are arranged in a second operating position;

(f) dropping a second ball of substantially similar dimensions to the first ball into the work string such that the second ball lands on the sleeve and forces the sleeve in said reverse direction back to the second position relative to the body wherein the first and second radial outlets are arranged in the intermediate operating position and fluid flow is restricted by the second ball; and (g) increasing pressure behind the second ball to cause the second ball to pass through the sleeve, the releasing pressure allowing the sleeve to move back to the first position relative to the body wherein the first and second radial outlets are arranged in the first operating position;

wherein the first and second radial outlets are aligned in one of the first and second operating positions and misaligned in the other one of the first and second operating positions.

44. An actuation mechanism for a downhole tool, the mechanism comprising:

a substantially cylindrical body having a central bore running axially therethrough and a plurality of first radial outlet ports;

a sleeve located within the bore, the sleeve including a deformable ball seat and a plurality of second radial outlet ports;

the sleeve being movable relative to the body between a first axial position in which the first and second radial outlet ports are in a first operating position, a second axial position spaced axially from the first axial position in which the first and second radial outlet ports are in an intermediate operating position, and a third axial position spaced axially from both the first and second axial positions in which the first and second radial outlet ports are in a second operating position, wherein the first and second radial outlet ports are aligned in one of the first and second operating positions and misaligned in the other one of the first and second operating positions;

mechanical biasing means located between the sleeve and the body to bias the sleeve in a first direction; and a ball;

wherein the deformable ball seat releasably retains the ball to prevent fluid flow through the sleeve thereby causing the sleeve to move in a reverse direction relative to the body from the first axial position to the second axial position; and wherein increasing pressure behind the ball causes the ball to pass through the sleeve such that the biasing means moves the sleeve in the first direction from the second axial position to the third axial position; and further wherein on release of the ball the seat returns to its original dimensions.

* * * * *